US010704456B2

(12) United States Patent
Dziubinschi et al.

(10) Patent No.: US 10,704,456 B2
(45) Date of Patent: Jul. 7, 2020

(54) FLUID MANAGEMENT SYSTEM FOR A HEAT EXCHANGER OF A VEHICLE AIR CONDITIONING SYSTEM

(71) Applicant: Hanon Systems, Daejeon (KR)

(72) Inventors: Alexandru Orest Dziubinschi, Dearborn, MI (US); David C. Letteer, Brighton, MI (US)

(73) Assignee: HANON SYSTEMS, Daejeon (KR)

( * ) Notice: Subject to any disclaimer, the term of this patent is extended or adjusted under 35 U.S.C. 154(b) by 23 days.

(21) Appl. No.: 15/968,814

(22) Filed: May 2, 2018

(65) Prior Publication Data

US 2018/0252149 A1 Sep. 6, 2018

Related U.S. Application Data

(62) Division of application No. 13/872,233, filed on Apr. 29, 2013, now Pat. No. 9,988,969.

(51) Int. Cl.
*F01P 11/10* (2006.01)

(52) U.S. Cl.
CPC ..... *F01P 11/10* (2013.01); *F01P 2060/14* (2013.01)

(58) Field of Classification Search
CPC ..... B60K 11/00; B60K 11/085; B62D 35/00
See application file for complete search history.

(56) References Cited

U.S. PATENT DOCUMENTS 4,173,995 A 11/1979 Beck
4,539,943 A 9/1985 Tsuchikawa et al.
4,604,974 A 8/1986 Watanabe
4,706,615 A 11/1987 Scadding
5,205,484 A * 4/1993 Susa ..... B60H 1/3227 236/35.3
5,219,016 A 6/1993 Bolton et al.
5,271,473 A 12/1993 Ikeda et al.
5,901,672 A 5/1999 Suzuki et al.
5,901,786 A * 5/1999 Patel ..... B60K 11/04 123/41.04
6,192,838 B1 2/2001 Matsuo et al.
6,390,217 B1 5/2002 O'Brien et al.
6,540,037 B2 4/2003 Sasano et al.
6,883,589 B2 4/2005 Ozawa et al.
7,451,844 B2 11/2008 Kunikata
7,497,287 B2 3/2009 Kunikata et al.
7,814,966 B2 10/2010 Prior
(Continued)

FOREIGN PATENT DOCUMENTS

JP 2001090538 A 4/2001
JP 2002201940 A 7/2002
(Continued)

*Primary Examiner* — John D Walters
*Assistant Examiner* — James J Triggs
(74) *Attorney, Agent, or Firm* — Shumaker, Loop & Kendrick, LLP; James D. Miller

(57) ABSTRACT

A fluid management system for a cooling module of a vehicle air conditioning system. The cooling module includes a first heat exchanger in fluid communication with a liquid cooling system of the vehicle and a second heat exchanger disposed upstream of the first heat exchanger and in fluid communication with the vehicle air conditioning system, wherein the fluid management system minimizes an inlet fluid temperature of the second heat exchanger of the cooling module.

13 Claims, 5 Drawing Sheets

(56) References Cited

U.S. PATENT DOCUMENTS

| | | | |
|---|---|---|---|
| 8,251,023 | B2 | 8/2012 | Kardos et al. |
| 8,297,393 | B2 | 10/2012 | Froeschle et al. |
| 8,302,714 | B2 | 11/2012 | Charnesky et al. |
| 8,316,805 | B2 | 11/2012 | Kardos et al. |
| 8,479,855 | B2 | 7/2013 | Kim et al. |
| 8,485,295 | B2 | 7/2013 | Mildner |
| 8,573,343 | B2 | 11/2013 | Komatsu et al. |
| 8,631,889 | B2 | 1/2014 | Begleiter et al. |
| 8,689,925 | B2 | 4/2014 | Ajisaka |
| 8,708,075 | B2 | 4/2014 | Maurer et al. |
| 8,794,360 | B2 | 8/2014 | Nemoto |
| 8,794,363 | B2 | 8/2014 | Wolf |
| 8,919,300 | B2 | 12/2014 | Klinkert et al. |
| 8,998,293 | B2 | 4/2015 | Glickman |
| 9,188,052 | B2 | 11/2015 | Tajima |
| 2001/0011614 | A1 | 8/2001 | Sasano et al. |
| 2006/0254838 | A1 | 11/2006 | Ino et al. |
| 2011/0114286 | A1 | 5/2011 | Komatsu et al. |
| 2011/0241378 | A1 | 10/2011 | Steller |
| 2013/0244562 | A1 | 9/2013 | Maurer et al. |
| 2013/0316634 | A1 | 11/2013 | Ajisaka |
| 2014/0069604 | A1 | 3/2014 | Tamakoshi |
| 2014/0138077 | A1 | 5/2014 | Ajisaka |
| 2014/0290296 | A1 | 10/2014 | Katoh |
| 2014/0299396 | A1 | 10/2014 | Tajima |
| 2014/0318735 | A1 | 10/2014 | Dziubinschi et al. |
| 2015/0041229 | A1 | 2/2015 | Maurer et al. |
| 2015/0252716 | A1 | 9/2015 | Tanno et al. |
| 2016/0031312 | A1 | 2/2016 | Kabbes et al. |

FOREIGN PATENT DOCUMENTS

| | | | |
|---|---|---|---|
| JP | 2007118651 | A | 5/2007 |
| KR | 20050038890 | A | 4/2005 |

* cited by examiner

FLUID MANAGEMENT SYSTEM FOR A HEAT EXCHANGER OF A VEHICLE AIR CONDITIONING SYSTEM

CROSS-REFERENCE TO RELATED PATENT APPLICATIONS

This is a divisional patent application of co-pending U.S. patent application Ser. No. 13/872,233 filed Apr. 29, 2013, the disclosure of which is incorporated herein by reference in its entirety.

FIELD OF THE INVENTION

The present invention relates generally to a fluid management system and, more particularly, to a fluid management system for a heat exchanger of a vehicle air conditioning system.

BACKGROUND OF THE INVENTION

Heat exchangers are commonly known in the art for a transfer of heat from one medium to another. Typically, the heat exchanger is disposed in series with a fluid circulation system for circulating a fluid through a stream of a cooling fluid. Such heat exchangers commonly include an inlet manifold for receiving the fluid from the fluid circulation system, an outlet manifold for returning the fluid to the fluid circulation system, and a conduit core interposed between the inlet manifold and the outlet manifold. The conduit core intercepts the stream of cooling fluid for the transfer of heat from the fluid of the fluid circulation system to the cooling fluid.

Typically, the heat exchangers are available in an assortment of sizes and structural configurations for specific applications. Heat exchangers of the foregoing type are regularly used in connection with a cooling module of a vehicle. Conventional vehicles are generally powered by an internal combustion engine which is cooled by a liquid cooling system including a first heat exchanger of the cooling module, commonly referred to as a radiator. For vehicles equipped with air conditioning, a second heat exchanger of the cooling pack, commonly referred to as a condenser, is affixed to a front side of the radiator. The condenser is utilized to cause a refrigerant of an air conditioning system of the vehicle which has been compressed into a high temperature, high pressure gas to be condensed into a low temperature, high pressure liquid. A fan of the cooling module is disposed on a back side of the radiator to cause the stream of cooling fluid to flow through the condenser and the radiator.

Presently, the condenser is subjected to a significant increase (i.e. 8° C.-30° C.) in average inlet air temperature over the ambient air temperature, especially when the vehicle is at idle. Higher inlet air temperatures affect a performance of the condenser, and consequently increase an operating pressure and power usage of a compressor of the air conditioning system, which can lead to performance and reliability degradation of the air conditioning system. Sources that contribute to the increase of the inlet air temperature are shown in FIG. 1 such as heated air from the ground 2, front end members (e.g. hood, bumper, etc.) of the vehicle 4, air recirculation from an underbody of the vehicle 6, air recirculation around the cooling module 8, and air recirculation from inside the cooling module 10.

It is evident that air recirculation is one of the main contributors to the increase in the inlet air temperature of the condenser. Numerous passive means have been proposed in the prior art for minimizing such air recirculation. One such means shown in FIG. 2 is the use of one or more seals 12. The seals are typically rubber flanges or foam members disposed along portions of an outer periphery of the condenser. However, the seals are susceptible to misalignment and damage caused thereto during assembly of the vehicle, as well as from exposure to harsh environmental conditions during use thereof.

It would desirable to produce a fluid management system for use with a heat exchanger of a vehicle air conditioning system, which minimizes an inlet fluid temperature of the heat exchanger.

SUMMARY OF THE INVENTION

In concordance and agreement with the present disclosure, a fluid management system for use with a heat exchanger of a vehicle air conditioning system, which minimizes an inlet fluid temperature of the heat exchanger, has surprisingly been discovered.

In one embodiment, a vehicle, comprises: a cooling module configured to receive a flow of a cooling fluid therein and discharge a flow of a heated cooling fluid therefrom; and a fluid management system configured to cause at least one of at least a portion of a flow of a third fluid to redirect at least a portion of a flow of a heated fluid, at least a portion of the flow of the heated cooling fluid to redirect at least a portion of the flow of the heated fluid, and at least a portion of the flow of the heated cooling fluid to be directed out of the vehicle.

In another embodiment, a vehicle, comprises: a cooling module including: a first heat exchanger configured to receive a first fluid therein, a second heat exchanger disposed adjacent the first heat exchanger and configured to receive a second fluid therein, wherein at least one of the first heat exchanger and the second heat exchanger is configured to receive a flow of a cooling fluid therein and discharge a flow of a heated cooling fluid therefrom; and a shroud disposed adjacent the first heat exchanger and configured to control the flow of the cooling fluid through at least one of the first heat exchanger and the second heat exchanger; and a fluid management system configured to cause at least one of at least a portion of a flow of a third fluid to redirect at least a portion of a flow of a heated fluid, at least a portion of the flow of the heated cooling fluid to redirect at least a portion of the flow of the heated fluid, and at least a portion of the flow of the heated cooling fluid to be directed out the vehicle.

The invention also relates to a method of fluid management for a cooling module of a vehicle.

The method comprises the steps of: providing a cooling module configured to receive a flow of a cooling fluid therein and discharge a flow of a heated cooling fluid therefrom; providing a system configured to provide fluid management for the cooling module; and causing at least one of at least a portion of a flow of a third fluid to redirect at least a portion of a flow of a heated fluid, at least a portion of the flow of the heated cooling fluid to redirect at least a portion of the flow of the heated fluid, and at least a portion of the flow of the heated cooling fluid to be directed out of the vehicle.

BRIEF DESCRIPTION OF THE DRAWINGS

The above, as well as other objects and advantages of the invention, will become readily apparent to those skilled in the art from reading of the following detailed description of the invention when considered in the light of the accompanying drawings in which.

DETAILED DESCRIPTION OF THE INVENTION

Figure 1:
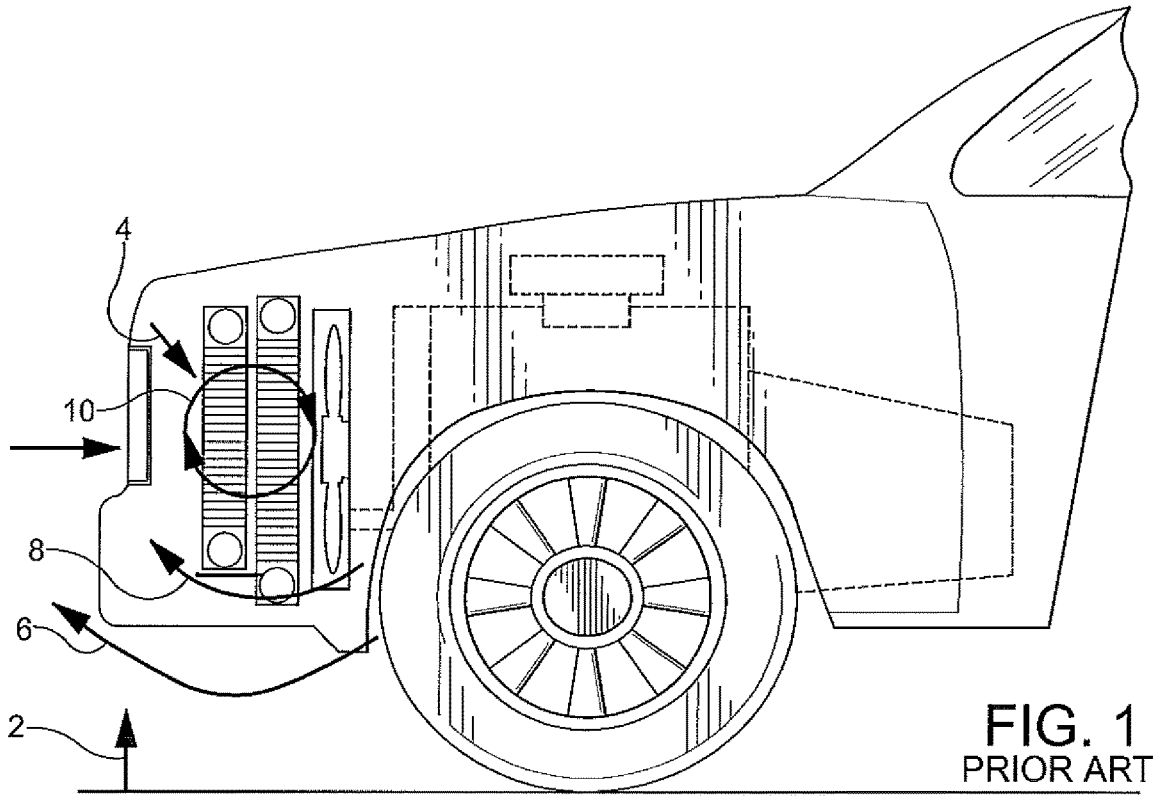
FIG. 1 PRIOR ART
FIG. 1 is a fragmentary schematic side elevational view of a front portion of a vehicle according to the prior art showing sources of air recirculation to an inlet region of a heat exchanger of an air conditioning system of the vehicle.

The following detailed description and appended drawings describe and illustrate various exemplary embodiments of the invention. The description and drawings serve to enable one skilled in the art to make and use the invention, and are not intended to limit the scope of the invention in any manner.

FIGS. 3-6 show various embodiments of a fluid management system 100 for a vehicle 101 according to the present invention. Each of the embodiments includes the vehicle 101 having a body 102 supported by a chassis represented by wheels 104. Located within a front portion 106 of the body 102, intermediate a front end 108 and a passenger compartment 110, is an engine compartment 112. An interior of the engine compartment 112 is defined by an operable hood 113 (shown only in FIG. 6) extending over the engine compartment 112, a pair of opposing front fenders 114, and the front end 108. Openings (not shown) are formed in the front end 108 allow for a flow of a cooling fluid A such as ambient air, for example, into the engine compartment 112. A decorative grille (not shown) may extend across the openings formed in the front end 108 if desired.

As shown, an internal combustion engine 120 and a cooling module 122 are disposed within the engine compartment 112 of the vehicle 101. The engine 120 is cooled by a liquid cooling system. The liquid cooling system includes a circuitous flow path or cooling jacket extending within the engine 120 for receiving a first fluid (e.g. an engine coolant) therein. The first fluid is circulated through the liquid cooling system by a prime mover (not shown) such as a hydraulic or electric pump, for example. After passage through the engine 120, the heated first fluid flows into a first heat exchanger 124, commonly referred to as a radiator, of the cooling module 122. Within the first heat exchanger 124, a temperature of the first fluid is decreased by heat transfer from the first fluid to the cooling fluid A (e.g. the ambient air) flowing therethrough. Once the first fluid is cooled, it flows from the first heat exchanger 124 through the circuitous flow path to the engine 120 to absorb heat therefrom.

The cooling module 122 further includes a second heat exchanger 126, commonly referred to as a condenser, disposed in front of the first heat exchanger 124. The second heat exchanger 126 shown is for use in an air conditioning system of the vehicle 101. The air conditioning system includes a compressor (not shown), the second heat exchanger 126, an expansion device (not shown), and an evaporator (not shown), all fluidly connected by a circuitous flow path. The circuitous flow path is capable of conveying a flow of a high or low-pressure second fluid such as a refrigerant, for example. Commonly, the second fluid used in the air conditioning system is a refrigerant such as R-134a, $CO_2$, and HFO-1234yf, for example. The compressor compresses and facilitates a flow of the second fluid throughout the air conditioning system. The compressor includes a suction side and a discharge side. The suction side is referred to as the low-pressure side and the discharge side is referred to as the high-pressure side.

The evaporator of the air conditioning system is usually disposed in the passenger compartment 110 of the vehicle 101. It is understood that the evaporator of the air conditioning system can be disposed elsewhere within the vehicle 101 if desired. Within the evaporator, a low-pressure two-phase mixture of liquid and vapor of the second fluid boils by absorbing heat from the passenger compartment 110. A cold, low-pressure, vapor form of the second fluid then exits from the evaporator. The cold, low-pressure, vapor form of the second fluid from the evaporator is received in the compressor and compressed thereby into a hot, high-pressure, vapor form of the second fluid. The compressed hot, high-pressure, vapor form of the second fluid is then discharged by the compressor to the second heat exchanger 126. As the hot, high-pressure, vapor form of the second fluid passes through the second heat exchanger 126, the second fluid is condensed to a warm, high-pressure, liquid form of the second fluid as it transfers the heat absorbed from the passenger compartment 110 and from the compression process to the cooling fluid flowing therethrough. Exiting the second heat exchanger 126, the warm, high-pressure, liquid form of the second fluid passes through the expansion device that regulates the flow of the second fluid to the evaporator. A temperature of the low-pressure, vapor form of the second fluid returning to the compressor from the evaporator is typically about 40° F. to about 100° F. lower than a temperature of the high-pressure, liquid form of the second fluid exiting the condenser.

The cooling module 122 may further include a third heat exchanger (not shown) employed for use with an engine oil system or a transmission fluid system, for example. The first heat exchanger 124, the second heat exchanger 126, and optionally, the third heat exchanger, function as an integrated heat transfer device for simultaneously cooling at least the first fluid of the liquid cooling system and the second fluid of the air conditioning system of the vehicle 101. A fluid-moving device 128 is employed in the cooling module 122 to cause the cooling fluid A to flow through the first heat exchanger 124, the second heat exchanger 126, and optionally, the third heat exchanger. The fluid-moving device 128 can be any conventional device as desired such as a fan or a blower, for example.

The flow of the cooling fluid A through the cooling module 122 is controlled by a shroud 130. The shroud 130 includes an end wall 132 having a continuous sidewall 134 extending therefrom. The sidewall 134 terminates with an edge defining an open end 138 adjacent an outlet region of the first heat exchanger 124. One or more outlet openings 140 are formed in the end wall 132 to permit a stream of a heated cooling fluid B, which has absorbed heat from the first fluid and the second fluid, to be discharged from the cooling module 122. The heated cooling fluid B discharged from the cooling module 122 circulates within the engine compartment 112.

Figure 3:
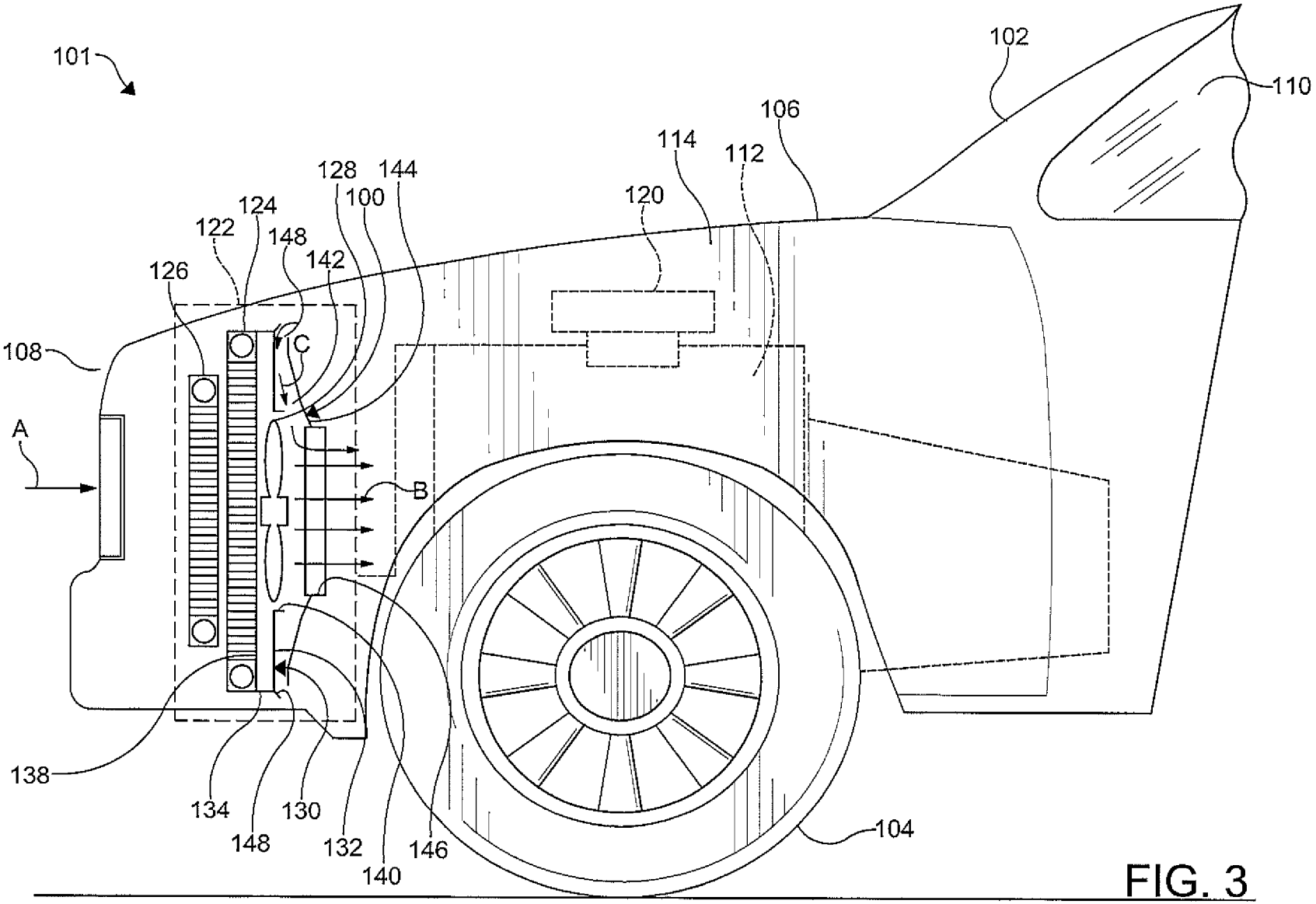
FIG. 3 is a fragmentary schematic side elevational view of a front portion of a vehicle including a fluid management system for an air conditioning system of the vehicle according to an embodiment of the present invention.

FIG. 3 shows the fluid management system 100 for the cooling module 122 of the vehicle 101 according to an embodiment of the invention. The fluid management system 100 includes one or more fluid flow paths 142 configured to minimize an amount of a heated fluid C that circulates to an inlet region of the second heat exchanger 126. The heated fluid C may include at least one of the heated cooling fluid B and heated air from one or more of the ground, front end members of the vehicle 100, an underbody of the vehicle 100, around the cooling module 122, and inside the cooling module 122. As the stream of the heated cooling fluid B is discharged from the cooling module 122, a static pressure at the outlet opening 140 of the shroud 130 decreases. When the static pressure at the outlet opening 140 of the shroud 130 is less than a pressure within the engine compartment 112, the pressure difference causes the heated fluid C to flow through the fluid flow paths 142 and converge with the stream of the heated cooling fluid B being discharged from the cooling module 122.

As shown, the fluid flow path 142 is formed between the end wall 132 of the shroud 130 and an additional wall 144 having a central opening 146 formed thereon. The additional wall 144 can substantially cover the end wall 132 of the shroud 130, as shown in FIG. 3, or can be a smaller segment covering only a pre-determined region of the shroud 130. Alternatively, at least one of the fluid flow paths 142 may be a channel, a vane, or other feature integrally formed in the end wall 132, eliminating the requirement for the additional wall 144. While the fluid flow paths 142 shown have openings 148 at an upper and a lower region of the cooling module 122, it is understood that the opening 148 of each of the fluid flow paths 142 can be disposed elsewhere downstream of the second heat exchanger 126 in any location suitable to minimize an amount of the heated fluid C that circulates to the inlet region of the second heat exchanger 126. For example, the openings 148 of the fluid flow paths 142 can be disposed adjacent opposing sides of the second heat exchanger 126 to cause the heated fluid C circulating around the cooling module 122 to converge with the stream of the heated cooling fluid B being discharged from the cooling module 122, thereby minimizing the amount of heated fluid C which flows to the inlet region of the second heat exchanger 126.

In use, the cooling fluid A is caused to flow from outside the vehicle 101 into the engine compartment 112 and through the second heat exchanger 126 and the first heat exchanger 124 of the cooling module 122 to absorb heat therefrom. As the heated cooling fluid B is discharged from the cooling module 122 into the engine compartment 112, the heated fluid C is caused to flow through the fluid flow paths 142 and converge with the stream of the heated cooling fluid B. Since the amount of heated fluid C which flows to the inlet region of the second heat exchanger 126 is minimized by the fluid management system 100, an inlet fluid temperature of the second heat exchanger 126 is also minimized. Accordingly, a performance of the second heat exchanger 126 is maximized, and consequently an operating pressure and power usage of a compressor of the air conditioning system is minimized, which optimizes performance and durability of the air conditioning system.

Figure 2:
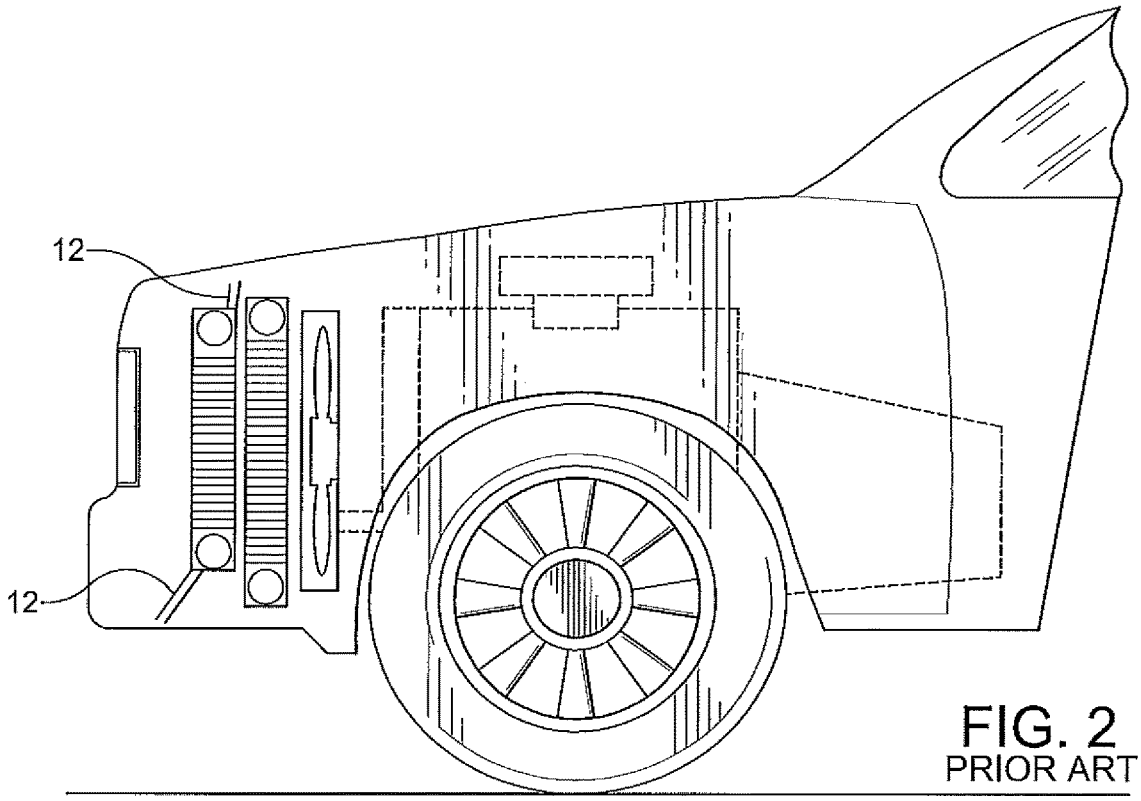
FIG. 2 PRIOR ART
FIG. 2 is a fragmentary schematic side elevational view of a front portion of a vehicle according to the prior art showing a passive means for minimizing the air recirculation shown in FIG. 1, wherein the passive means is a plurality of seals disposed along portions of an outer periphery of the heat exchanger.
Figure 4:
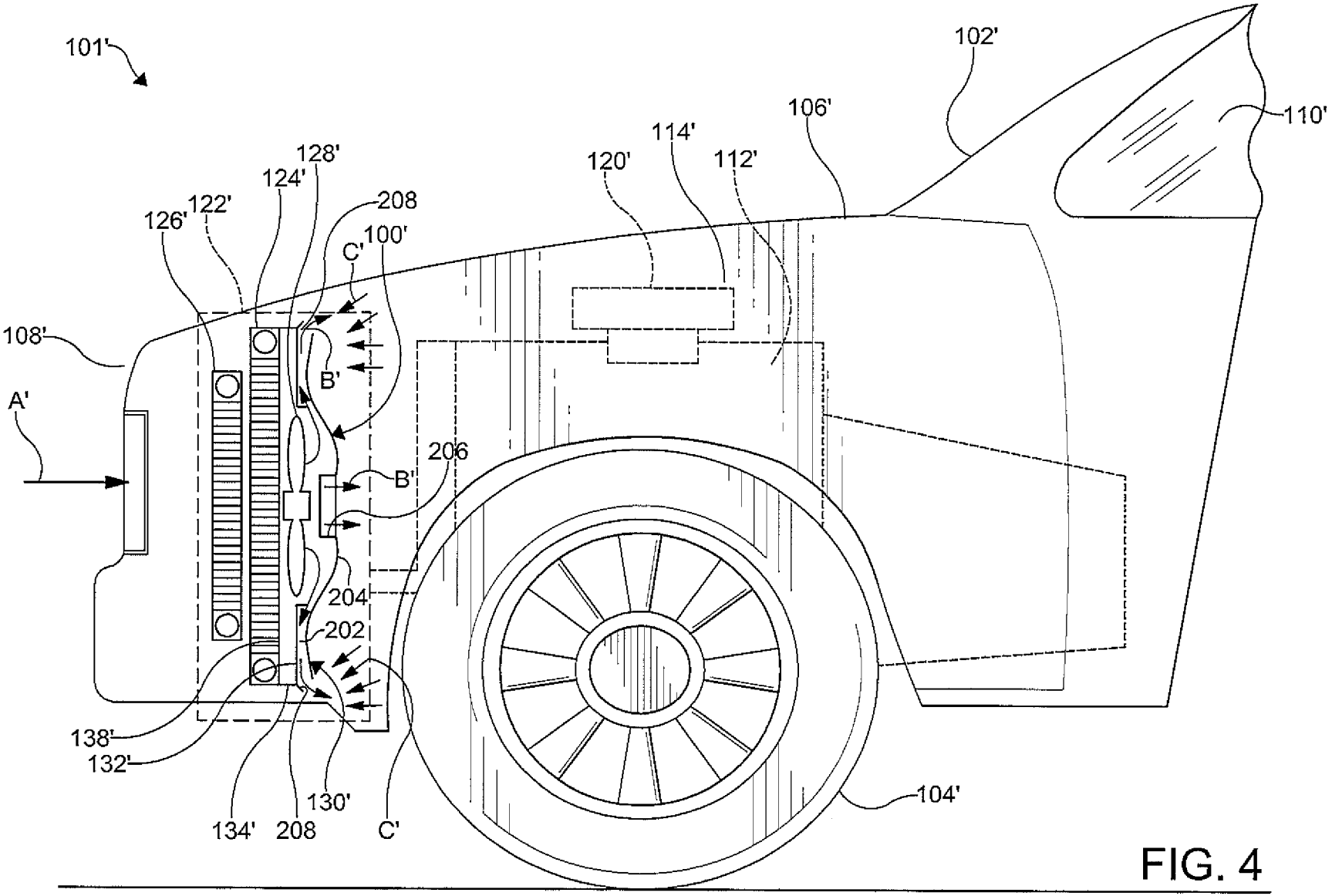
FIG. 4 is a fragmentary schematic side elevational view of a front portion of a vehicle including a fluid management system for an air conditioning system of the vehicle according to another embodiment of the present invention.

FIG. 4 shows another embodiment of the fluid management system 100 illustrated in FIG. 3. Structure similar to that illustrated in FIGS. 1-3 includes the same reference numeral and a prime (') symbol for clarity. In FIG. 4, the fluid management system 100' is substantially similar to the fluid management system 100, except as described hereinbelow.

The fluid management system 100' includes one or more fluid flow paths 202 configured to minimize an amount of the heated fluid that circulates to an inlet region of the second heat exchanger 126'. The fluid flow paths 202 guide the stream of the heated cooling fluid B' to at least one region of the engine compartment 112' where it can be easily vented outside the engine compartment 112' and/or where it opposes a flow of the heated fluid C' which may circulate to the inlet region of the second heat exchanger 126'. As illustrated, the fluid flow paths 202 are formed between the end wall 132' of the shroud 130' and an additional wall 204 having a central opening 206 formed thereon. The additional wall 204 can substantially cover the end wall 132' of the shroud 130', as shown in FIG. 4, or can be a smaller segment covering only a pre-determined region of the shroud 130'. Alternatively, at least one of the fluid flow paths 202 may be a channel, a vane, or other feature integrally formed in the end wall 132', eliminating the requirement for the additional wall 204.

While the fluid flow paths 202 shown have openings 208 at an upper region and a lower region of the cooling module 122', it is understood that the opening 208 of each of the fluid flow paths 202 can be disposed elsewhere downstream of the second heat exchanger 126' in any location suitable to minimize the amount of the heated fluid C' that flows to the inlet region of the second heat exchanger 126'. For example, the openings 208 of the fluid flow paths 202 can be disposed adjacent opposing sides of the second heat exchanger 126' to cause the heated fluid C' circulating around the cooling module 122' to converge with the stream of the heated cooling fluid B being discharged from the cooling module 122', thereby minimizing the amount of heated fluid C' which flows to the inlet region of the second heat exchanger 126'.

In use, the cooling fluid A is caused to flow from outside the vehicle 101' into the engine compartment 112' and through the second heat exchanger 126' and the first heat exchanger 124' of the cooling module 122' to absorb heat therefrom. The heated cooling fluid B' is then discharged from the cooling module 122' through the fluid flow paths 202 and is caused to be vented from the engine compartment 112' and/or be directed in opposition to a flow of the heated fluid C' which may circulate to the inlet region of the second heat exchanger 126'. Since the amount of heated fluid C' which flows to the inlet region of the second heat exchanger 126' is minimized by the fluid management system 100', an inlet fluid temperature of the second heat exchanger 126' is also minimized. Accordingly, a performance of the second heat exchanger 126' is maximized, and consequently an operating pressure and power usage of a compressor of the air conditioning system is minimized, which optimizes a performance and a durability of the air conditioning system.

Figure 5:
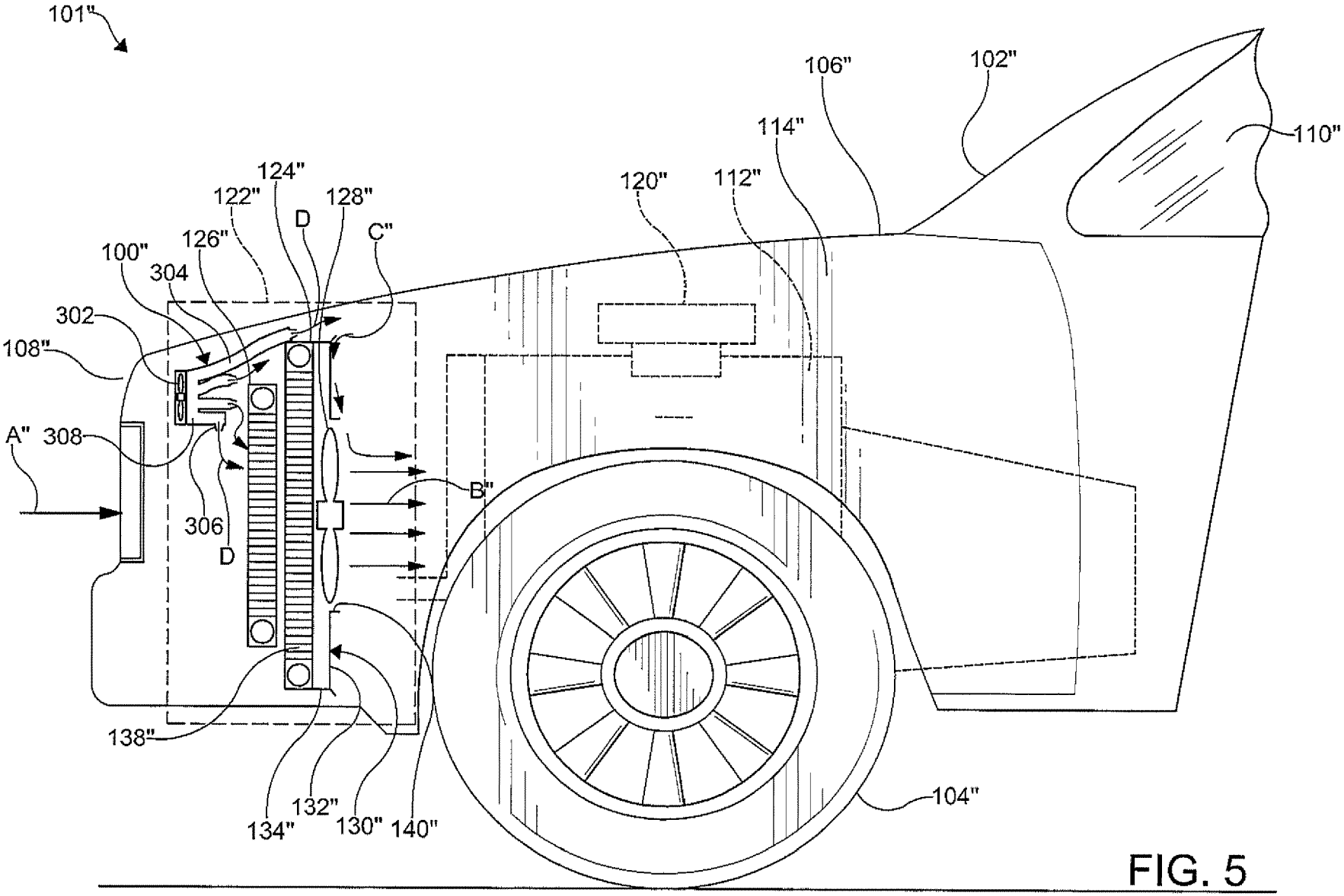
FIG. 5 is a fragmentary schematic side elevational view of a front portion of a vehicle including a fluid management system for an air conditioning system of the vehicle according to another embodiment of the present invention.

FIG. 5 shows another embodiment of the fluid management system 100, 100' illustrated in FIGS. 3 and 4, respectively. Structure similar to that illustrated in FIGS. 1-4 includes the same reference numeral and a double prime (") symbol for clarity.

In FIG. 5, the fluid management system 100" includes a source of fluid 302 such as a fluid-moving device, for example, and one or more fluid flow paths 304 configured to minimize an amount of the heated fluid C" that flows to an inlet region of the second heat exchanger 126". As illustrated, each of the fluid flow paths 304 is formed by a nozzle 306 and ducting 308 fluidly connecting the nozzle 306 with the source of fluid 302. One or more valves (not shown) may be disposed within the fluid flow paths 304 to selectively control a flow of a third fluid D from the source of fluid 302 and through the nozzles 306. It is understood that any suitable valve can be used such as a butterfly valve, a flapper valve, a solenoid valve, and the like, for example. It is also understood that the third fluid D can be any fluid as desired such as the cooling fluid A (e.g. ambient air), for example. The nozzles 304 and the ducting 308 can be formed from any material as desired such as a substantially flexible material, a substantially rigid material, a plastic material, a metal material, or the like, for example. The source of fluid 302 and the fluid flow paths 304 may be disposed in a front portion 106" of a body 102" of the vehicle 101" and an engine compartment 112". The fluid flow paths 304 each guide a stream of the third fluid D to the inlet region of the second heat exchanger 126" and/or to a region of the engine compartment 112" where it opposes a flow of the heated fluid C" which may circulate to the inlet region of the second heat exchanger 126". The stream of the third fluid D output from the nozzle 306 may be used to dilute the heated fluid C" which enters the inlet region of the second heat exchanger 126". While the fluid flow path 302 is shown as having the nozzles 306 directed to an upper region of the cooling module 122", it is understood that the nozzles 306 can be positioned elsewhere in any location and direction suitable to minimize the amount of the heated fluid C" that flows to the inlet region of the second heat exchanger 126". For example, the nozzles 306 of the fluid flow paths 202" can be disposed adjacent opposing sides of the second heat exchanger 126" to militate against the heated fluid C" circulating around the cooling module 122" to the inlet region of the second heat exchanger 126". The source of fluid 302 can be activated upon operation of the air conditioning system or selectively activated for certain operating conditions of the vehicle 101" such as when a speed of the vehicle 101" is less than a predetermined speed, the inlet fluid temperature of the second heat exchanger 126" reaches a predetermined temperature, or a discharge pressure of the compressor of the air conditioning system reaches a predetermined discharge pressure, for example.

Figure 6:
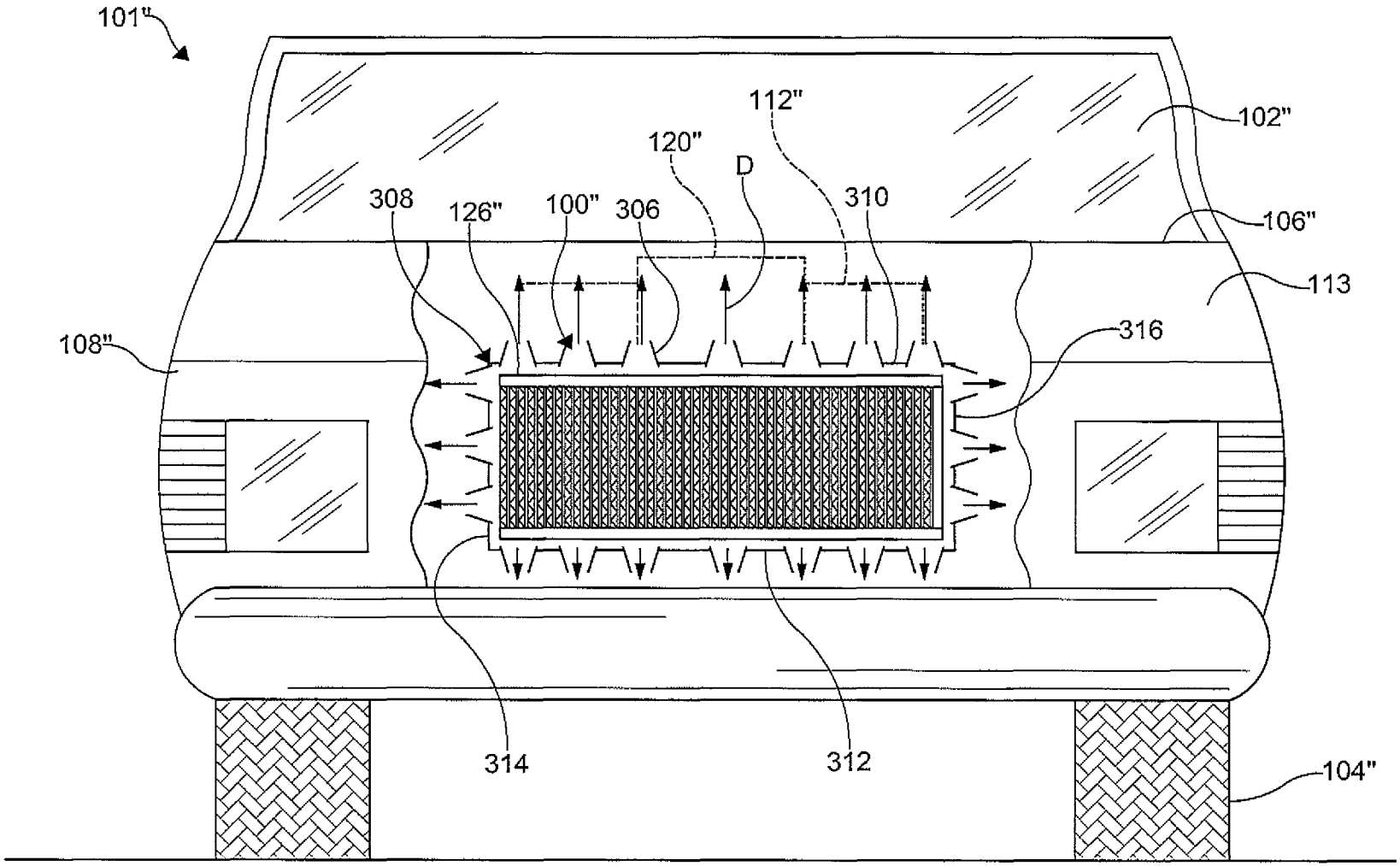
FIG. 6 is a schematic front elevational view of a front portion of a vehicle with a portion thereof cutaway and including an alternate configuration of the fluid management system shown in FIG. 5.

As shown in FIG. 6, the ducting 308 of the fluid management system 100" includes a first portion 310 disposed adjacent an upper portion of the second heat exchanger 126", a second portion 312 disposed adjacent a lower portion of the second heat exchanger 126", a third portion 314 disposed adjacent a first side portion of the second heat exchanger 126", and a fourth portion 316 disposed adjacent a second opposite side portion of the second heat exchanger 126". Each of the portions 310, 312, 314, 316 of the ducting 308 is provided with a plurality of nozzles 306 to direct the stream of the third fluid D being discharged therefrom. While seven nozzles 306 are shown in each of the first portion 310 and the second portion 312, and three nozzles 306 are shown in each of the third portion 314 and the fourth portion 316, any number of nozzles 306 may be used to provide a stream of the third fluid D to a desired location within the engine compartment 112". It is understood that one or more of the nozzles 306 of at least one of the portions 310, 312, 314, 316 of the ducting 308 can be configured to provide a curtain of the third fluid D to minimize the amount of the heated fluid C" that flows to the inlet region of the second heat exchanger 126".

In use, the cooling fluid A is caused to flow from outside the vehicle 101" into the engine compartment 112" and through the second heat exchanger 126" and the first heat exchanger 124" of the cooling module 122" to absorb heat therefrom. The heated cooling fluid B is discharged from the cooling module 122" into the engine compartment 112". Upon activation of the fluid management system 100", the third fluid D is caused to flow from the source of fluid 302, through the ducting 308 of the fluid flow paths 308, and through the nozzles 306. The nozzles 306 direct the stream of the third fluid D towards the inlet region of the second heat exchanger 126" to dilute a flow of the heated fluid C" and/or in opposition to the flow of the heated fluid C" which may circulate to the inlet region of the second heat exchanger 126" minimizing an amount of the heated fluid C" which flows to the inlet region of the second heat exchanger 126". Since the amount of heated fluid C" which circulates to the inlet region of the second heat exchanger 126" is minimized by the fluid management system 100", an inlet fluid temperature of the second heat exchanger 126" is also minimized. Accordingly, a performance of the second heat exchanger 126" is maximized, and consequently an operating pressure and power usage of a compressor of the air conditioning system is minimized, which optimizes performance and durability of the air conditioning system.

In other embodiments, the fluid management systems 100, 100', 100" can be used in combination to minimize an inlet fluid temperature of the second heat exchangers 126, 126', 126".

In yet other embodiments, the fluid management systems 100, 100', 100", alone or in combination, can be used in combination with the prior art passive means for minimizing the amount of the heated fluid C, C', C" which flows to the inlet region of the second heat exchanger 126, 126', 126".

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A vehicle, comprising:

a cooling module configured to receive a flow of a cooling fluid therein and discharge a flow of a heated cooling fluid therefrom; and a fluid management system configured to cause at least a portion of a flow of a third fluid to redirect at least a portion of a flow of a heated fluid, wherein the fluid management system includes a device configured to cause the flow of the third fluid through at least one fluid flow path formed by a nozzle and a duct fluidly connecting the nozzle and the device.

2. The vehicle of claim 1, wherein the at least a portion of the flow of the third fluid redirects the at least a portion of the flow of the heated fluid by creating a fluid curtain.

3. The vehicle of claim 1, wherein the at least a portion of the flow of the third fluid redirects the at least a portion of the flow of the heated fluid by creating a fluid curtain and another portion of the flow of the third fluid is directed into the cooling module.

4. The vehicle of claim 1, wherein the at least a portion of the flow of the third fluid redirects the at least a portion of the flow of the heated fluid by an opposition thereto and another portion of the flow of the third fluid is directed into the cooling module.

5. The vehicle of claim 1, wherein the cooling fluid is ambient air from outside an engine compartment of the vehicle.

6. The vehicle of claim 1, wherein the cooling module includes at least one heat exchanger, and the heated cooling fluid is ambient air from outside an engine compartment of the vehicle which has absorbed heat from a fluid flowing through the at least one heat exchanger of the cooling module.

7. The vehicle of claim 1, wherein the heated fluid is at least one of the heated cooling fluid, a heated air circulating from a ground surface, a heated air circulating from front end members of the vehicle, a heated air circulating from an underbody of the vehicle, a heated air circulating around the cooling module, and a heated air circulating inside the cooling module.

8. The vehicle of claim 1, wherein the third fluid is at least one of ambient air from outside an engine compartment of the vehicle, the heated cooling fluid, a heated air circulating from a ground surface, a heated air circulating from front end members of the vehicle, a heated air circulating from an underbody of the vehicle, a heated air circulating around the cooling module, and a heated air circulating inside the cooling module.

9. A vehicle, comprising:

a cooling module including:

a first heat exchanger configured to receive a first fluid therein, a second heat exchanger disposed adjacent the first heat exchanger and configured to receive a second fluid therein, wherein at least one of the first heat exchanger and the second heat exchanger is configured to receive a flow of a cooling fluid therein and discharge a flow of a heated cooling fluid therefrom; and a shroud disposed adjacent the first heat exchanger and configured to control the flow of the cooling fluid through at least one of the first heat exchanger and the second heat exchanger; and a fluid management system configured to cause at least a portion of a flow of a third fluid to redirect at least a portion of a flow of a heated fluid, wherein the fluid management system includes a device configured to cause the flow of the third fluid through at least one fluid flow path formed by a nozzle and a duct fluidly connecting the nozzle and the device.

10. The vehicle of claim 9, wherein the fluid management system is one of at least partially disposed adjacent to the cooling module and at least partially disposed within the cooling module.

11. The vehicle of claim 9, wherein the fluid management system includes a plurality of nozzles configured to cause the at least a portion of the flow of the third fluid to redirect the at least a portion of the flow of the heated fluid by creating a fluid curtain.

12. The vehicle of claim 9, wherein the fluid management system includes a plurality of nozzles configured to cause the at least a portion of the flow of the third fluid to redirect the at least a portion of the flow of the heated fluid by creating a fluid curtain and at least another nozzle configured to cause another portion of the flow of the third fluid to be directed into the cooling module.

13. The vehicle of claim 9, wherein the fluid management system includes the nozzle configured to cause the at least a portion of the flow of the third fluid to redirect the at least a portion of the flow of the heated fluid by an opposition thereto and another nozzle configured to cause another portion of the flow of the third fluid to be directed into the cooling module.

* * * * *